United States Patent [19]

Guanella

[11] 3,970,790

[45] July 20, 1976

[54] METHOD AND DEVICE FOR THE CODED TRANSMISSION OF MESSAGES

[75] Inventor: Gustav Guanella, Zurich, Switzerland

[73] Assignee: Patelhold Patentverwertungs & Elektro-Holding AG, Glarus, Switzerland

[22] Filed: Mar. 7, 1974

[21] Appl. No.: 448,977

[30] Foreign Application Priority Data

Mar. 19, 1973 Switzerland ..... 3876/73

[52] U.S. Cl. ..... 179/1.5 S; 178/22; 79/1.5 R

[51] Int. Cl.[2] ..... H04K 1/06

[58] Field of Search ..... 178/22; 179/1.5 S

[56] References Cited

UNITED STATES PATENTS

| | | | |
|---|---|---|---|
| 3,188,391 | 6/1965 | Raymond et al. | 179/1.5 S |
| 3,657,699 | 4/1972 | Rocher | 178/22 |
| 3,731,197 | 5/1973 | Clark | 178/22 |
| 3,796,830 | 3/1974 | Smith | 178/22 |
| 3,824,467 | 7/1974 | French | 178/22 |

*Primary Examiner*—Howard A. Birmiel
*Attorney, Agent, or Firm*—Frank L. Durr; Orville N. Greene

[57] ABSTRACT

Method and apparatus are disclosed whereby messages are encoded by message element exchangers which utilize a delay device for transposing selected pairs of message elements so that the first element of the pair undergoes a delay 2T and the remaining message element of the pair experiences no delay. Message elements not treated in pairs undergo a delay T. The delay T is an integral multiple of the duration of a message element (said elements preferably being of equal length $T_0$). Transmitted messages which have undergone selective transposition are decoded in a similar fashion, whereby the undelayed message element of a pair undergoes a delay 2T, the remaining element of the pair undergoes no delay and messages elements not treated in pairs undergo a delay T.

Exchangers of dissimilar delay periods may be connected in cascade to enhance the number of possible delay displacements which message elements may undergo. Also exchangers may be adapted to utilize plural delay devices to provide for further permutation of message elements.

41 Claims, 23 Drawing Figures

FIG.1
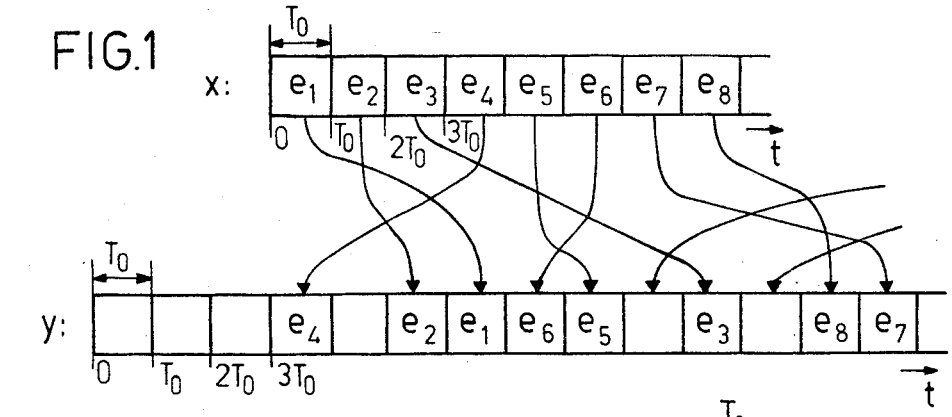
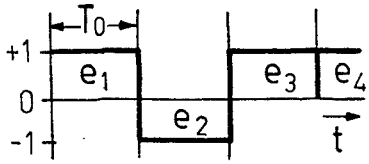
FIG.2
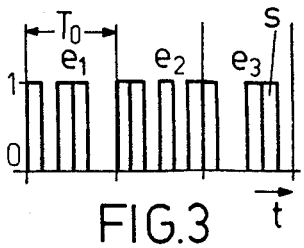
FIG.3
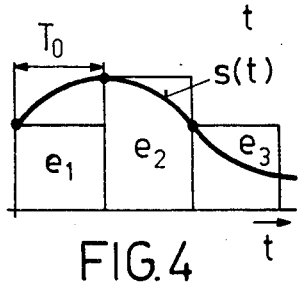
FIG.4
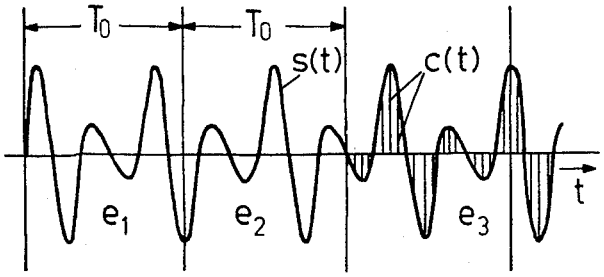
FIG.5
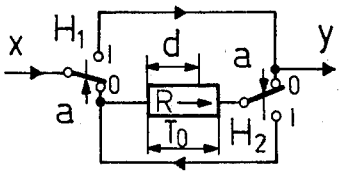
FIG.6
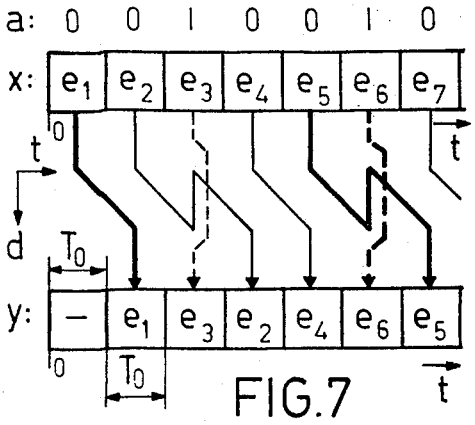
FIG.7
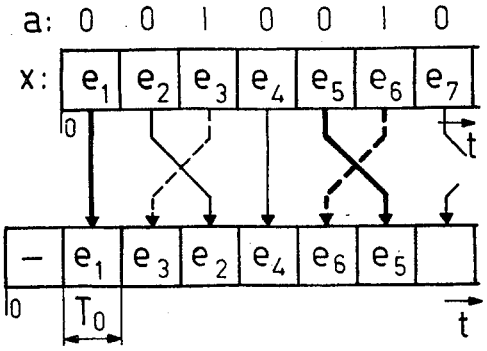
FIG.8

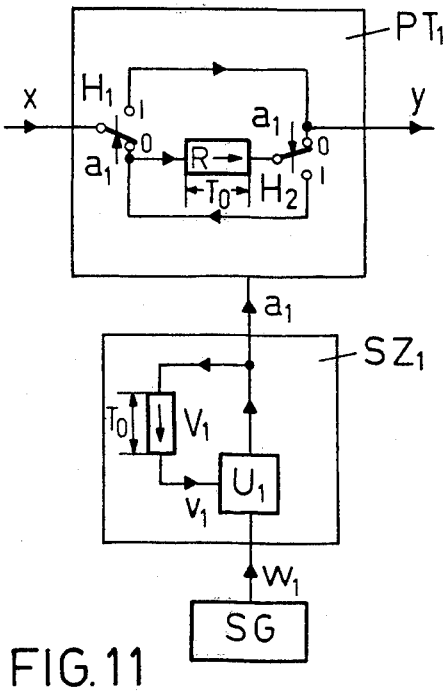
FIG. 11
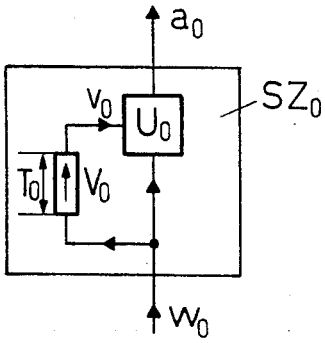
FIG. 9
$w_0$ : 0 0 1 1 0 1 1 1 0
$a_0$ : 0 0 1 0 0 1 0 0 0
FIG. 10
$w_1$ : 0 0 1 1 0 1 1 1 0
$a_1$ : 0 0 1 0 0 1 0 1 0
FIG. 12
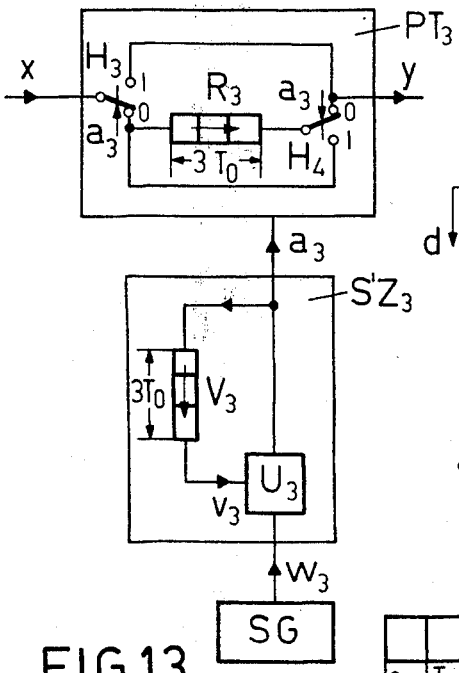
FIG. 13
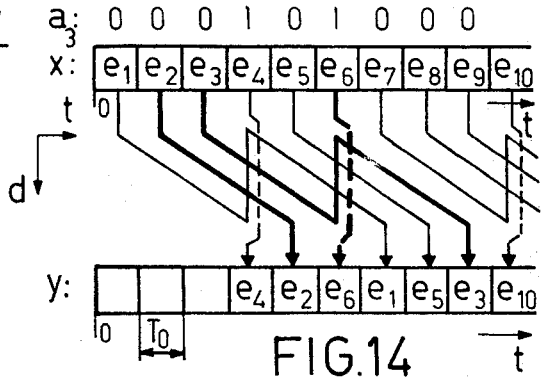
FIG. 14
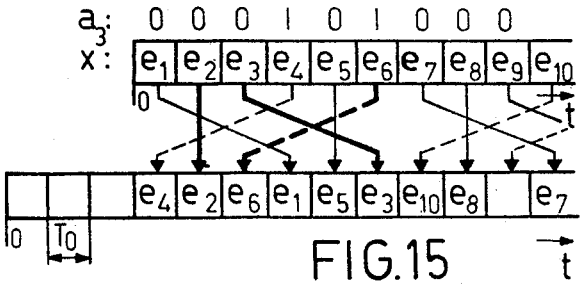
FIG. 15

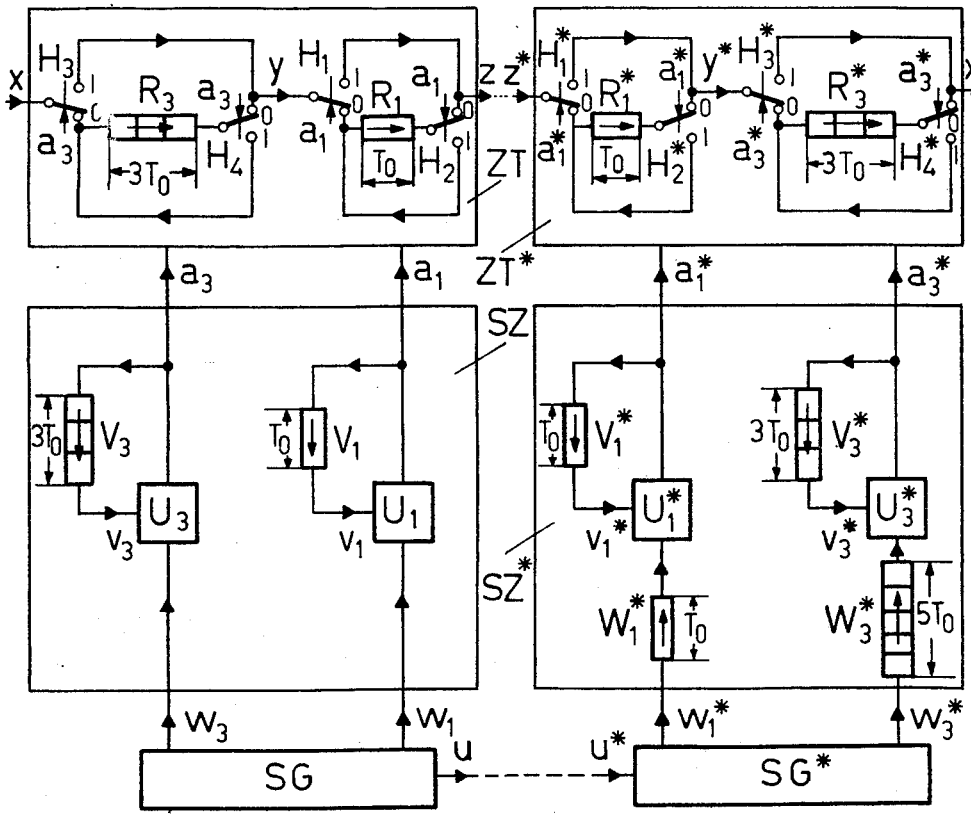
FIG.16
FIG.17
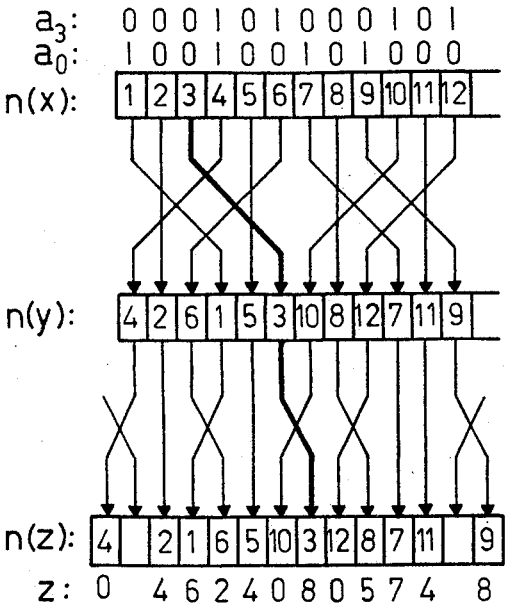
FIG.18
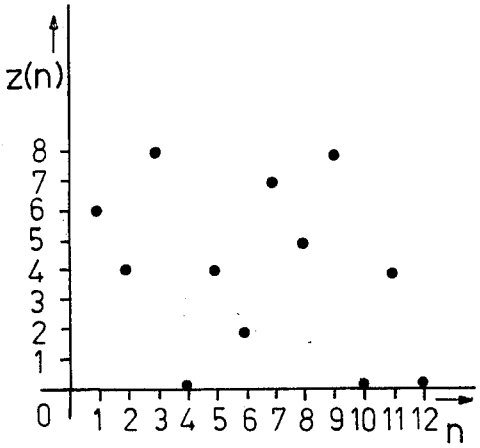
FIG.19

METHOD AND DEVICE FOR THE CODED TRANSMISSION OF MESSAGES

BACKGROUND OF THE INVENTION

The invention relates to a method and apparatus for the coded transmission of messages by splitting up the clear (i.e. uncoded) signals to be transmitted into elements of equal length, which are transposed at the transmitting end by being delayed by at least partially different times and are transposed back at the receiving end by being further delayed by at least partially different times. The consecutively numbered elements $e_1$, $e_2$, $e_3$, . . . of the clear signal $x$ have coinciding lengths $T_o$ (see FIG. 1), and their transposition in time leads, for example, to the coded signal $y$, of which the first element $e_4$ appears undelayed at the moment $t = 3T_o$, while the other elements appear with varying delay. After transmission of the signal $y$ at a receiver, the elements are restored to their original position by retransposition in order to recover the original clear signal.

The elements $e_1$, $e_2$, . . . may, as shown in FIG. 2, be pulses of the duration $T_o$, which are keyed between −1 and +1 or between 0 and 1 in accordance with a telegraphic message. Each element may, however, also comprise a plurality of individual pulses of a data signal $s$, as shown in FIG. 3. The pulses may also be quantized in a plurality of stages. The formation of elements, the amplitude of which corresponds to the scanned values, formed at intervals $T_o$, of a continuously variable clear signal $s(t)$, is shown in FIG. 4. Instead, however, sections of the clear signal $s(t)$ of constant length $T_o$ may be formed as elements $e_1$, $e_2$, . . . as shown in FIG. 5. FIG. 5 also indicates that, instead of these continuously variable signal sections, a train of short individual pulses $c(t)$ is suitable for forming the elements (see element $e_3$). Now, as a result of the encodingprocess, the sequence of such elements in time is altered, while the nature of the individual elements can remain unaltered.

Methods and devices for time coding, that is to say for the transposition in time of message elements, have become known for example through the Swiss Pat. No. 212,742 and 232,786, which describe how omissions and also repetitions of individual elements are avoided by periodically actuated switches. A periodic repetition of the transposition program effected at short intervals is undesirable, however, for cryptologic reasons. Accordingly, in the Swiss Pat. No. 518,658, a method is described which renders possible the control of the transposition process by random signals, as a result of which, periodic repetitions of the transposition program during a transmission are avoided. This control is achieved by means of a separate position register which, however, considerably increases the total expenditure necessary. The total expenditure on known devices is also comparatively heavy because the storage devices used are generally only partially filled with message elements wherein at least 50% of the stored locations remain unoccupied at any moment.

BRIEF DESCRIPTION OF THE INVENTION AND OBJECTS

According to the invention, these disadvantages are avoided by transposition in pairs of two elements at a time, which have a specific mutual spacing, at the transmitting end and retransposition of the same elements in pairs at the receiving end, the pairs of elements being transposed or retransposed at the transmitting end and at the receiving end being determined by irregular trains of control pulses which coincide at the two ends, and the elements which do not belong to the pairs of elements being delayed at the transmitting and receiving ends by a fixed time T, while the element of each pair which arrives first is delayed by double the time 2T at the transmitting and receiving ends and the second element is not delayed.

It is therefore one object of the invention to provide method and apparatus for encoding and/or decoding messages by transposing selected pairs of message elements while leaving remaining message elements untransposed.

Another object of the invention is to provide method and apparatus for encoding and/or decoding messages by transposing selected pairs of message elements so that one element of the pair undergoes a delay 2T and the remaining element of the pair undergoes no delay.

Still another object of the invention is to provide method and apparatus for encoding and/or decoding messages by transposing selected pairs of message elements so that one element of the pair undergoes a delay 2T and the remaining element of the pair undergoes no delay and wherein message elements not treated in pairs undergo a delay T, so that $T = n\ T_o$ where $T_o$ = message element length, and $n = 1,2,3, \ldots, n$.

BRIEF DESCRIPTION OF THE FIGURES

The above, as well as other objects of the invention, will become apparent from the following description and drawings, in which:

FIG. 1 shows one manner in which message elements of a message may be transposed.

FIGS. 2 – 5 show waveforms of various message formats which may undergo encoding (and decoding) by the techniques and apparatus of the present invention.

FIG. 6 shows a circuit for carrying out the exchange of message elements in pairs, FIGS. 7 and 8 are diagrammatical illustrations of the exchange of adjacent elements, FIGS. 9 and 11 show circuits for obtaining control signals for the actuation of the transposition switch from cipher signals, FIGS. 10 and 12 show examples of cipher signals and control signals obtained therefrom, FIG. 13 shows a circuit for the transposition in pairs of non-adjacent elements with associated circuitry for obtaining the control signals, FIGS. 14 and 15 are diagrammatic illustrations of the exchange in pairs of non-adjacent elements, FIGS. 16 and 17 show a circuit for the repeated exchange in pairs with cipher-signal preparation and a circuit for the repeated re-exchange with cipher-signal preparation, FIG. 18 is a diagrammatic illustration of the repeated exchange in pairs, FIG. 19 is an illustration of the delay times which occur with repeated exchange in pairs.

DETAILED DESCRIPTION OF THE INVENTION

Figure 20:
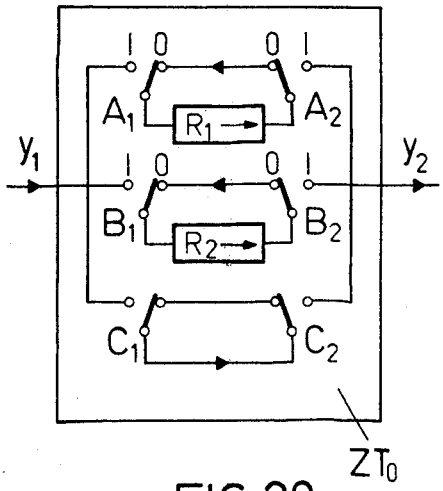
FIG. 20 shows a circuit for permutation in accordance with a constant program.

An explanation of the invention will now be given with reference to FIG. 6, which shows a simple circuit for carrying out the exchange of elements in pairs. The circuit contains a retarder R with the transit time $T_o$, which corresponds to the length of one message element. This retarder can be connected, through the switches $H_1$, $H_2$ (in position "O", as shown), to the input line and the output line of the circuit so that one element at a time of the clear signal $x$ is supplied to the retarder, while at the same time a stored or delayed element is extracted therefrom as output signal $y$. By means of a pulse of the control signal a with the duration $T_o$, on the other hand, the switches are brought into the position designated by "I", so that one element of the input signal $x$ at a time again appears directly as an element of the output signal $y$, while the preceding input element continues to be stored by being fed back from the output to the input of the retarder. The position of the beginning of the element in the retarder is indicated by the variable length $d$.

In the absence of a pulse of the control signal $a$, therefore, an element $e_1$ of the input signal $x$ will reappear as element $e_1$ of the output signal $y$ after the time $T_o$, as shown in FIG. 7. In the course of the duration of the element $e_6$, on the other hand, for example, a pulse of the control signal a appears so that this element reaches the output without delay, through the switch $H_1$, (indicated in broken lines in FIG. 7), while the preceding element $e_5$ is fed back to the input of the retarder through the switch $H_2$ and therefore only reaches the output of the circuit after an additional delay time $T_o$ or with a total delay $2T_o$. The passage through twice can be recognized by the position $d$ of the initial edge of the element, which can be seen from FIG. 7. Whereas the element $e_1$ is merely delayed by the time $T_o$, therefore, a delay reduced to 0 has occurred with the element $e_6$ and a delay increased to $2T_o$ with the element $e_5$, so that these last two elements appear transposed in time in the output signal $y$. In a similar way, the pair of elements $e_2$, $e_3$ is also transposed in time as shown in FIG. 7, while the element $e_4$ for example is transmitted with delay but without transposition with any other element. The same transpositions are indicated again diagrammatically in FIG. 8. It should be noted that the time zero has been advanced (i.e. shifted one "frame" to the left) by one time interval $T_o$ in the signal $y$ in order to achieve a clearer illustration.

It should be noted that during the transposition in pairs as described, the switches $H_1$, $H_2$ should never be actuated for longer than the duration $T_o$ of one element, in order that no element may be stored longer than $2T_o$. Accordingly, immediate repetitions (for example 00110) of the switching pulses are not permitted on the control signal $a$. In order to extract the control signals $a_o$ from a cipher-signal $w_o$ following a quasi-random course, a cipher-signal addition circuit $SZ_o$ as shown in FIG. 9 is therefore suitable. As a result of delaying each individual pulse of the cipher signal $w_o$ by the element length $T_o$ in the retarder $V_o$, a blocking signal $v_o$ results which suppresses a possible following pulse of the cipher signal in the interrupter $U_o$. The effect of this suppression is shown by way of example in FIG. 10. The suppressed pulses are designated by underlining. A disadvantage in this case, however, is that with an uninterrupted train of three or more pulses, all the pulses except the first are cancelled. This disadvantage is avoided with the cipher-signal addition circuit $SZ_1$ shown in FIG. 11, in which the interrupter $U_1$ is actuated by the pulses of the control signal $a_1$ delayed in $v_1$. With an uninterrupted train of a plurality of pulses of the cipher signal $w_1$, only every other pulse is suppressed in this case so that the control signal $a_1$ indicated in FIG. 12 results for example, and meets the requirements for an exchange of elements in pairs. In FIG. 11, apart from the device $PT_1$ already explained for the exchange of elements in pairs, a cipher-signal generator SG is indicated, the construction and mode of operation of which may correspond to known constructions. Devices for generating cipher signals with digital circuits are described for example in the Swiss Pat. No. 361,839.

Depending on the nature of the clear signals $x$, digital or analogue stores of known construction should be used as retarders R for exchanging the elements in the pair exchanger PT. In this case, it may be a question of delay lines or balancing networks, electro-mechanical retarders (for example acoustic systems) or electromagentic stores (for example magnetic sound recording with moving medium). Electrical shift registers are particularly suitable, with which signals keyed digitally (for example as shown in FIGS. 2 and 3) can easily be stored if operated at an appropriate clock frequency. With analogue signals (for example as shown in FIGS. 4 and 5), periodic scanning and storage of the scanned values ($c(t)$ in FIG. 5) is necessary. These scanned values can also be converted, by binary coding, into corresponding pulse groups, the storage of which is then effected with digital stores having an appropriately larger number of stages. In this case, with the pair exchanger $PT_1$ shown in FIG. 11, it is necessary to connect an analogue-digital converted at the input side to extract digital input signals from the clear signal $x$ and to connect a digital-analogue converter at the output side to extract output signals $y$ in analogue form. Delta modulation is also possible, however, instead of the binary coding. The changeover switches $H_1$, $H_2$ may appropriately be realized by suitably controlled semiconductor switching elements, which is also true for the interrupter $U_1$ in the cipher-signal addition circuit $SZ_1$.

The effectiveness of the time coding is increased by transposition in pairs, of elements which are not immediately adjacent. In FIG. 13 a device $PT_3$ is shown for the transposition in pairs of two elements at a time, the beginnings of which have a mutual spacing of three element lengths $T_o$, and corresponding element trains are illustrated in FIGS. 14 and 15 to explain the operation by way of example. When the switches $H_3$, $H_4$ are in the normal position shown, the elements of the output signal y appear delayed by $3T_o$ in comparison with the input signal $x$, if the delay of the retarder $R_3$ likewise amounts to $3T_o$. This is the case, for example, with the element $e_2$ (see FIG. 14), because said switches are in the normal position shown both during the supply and also during the extraction of this element. Although the element $e_3$ is likewise supplied to the retarder through the switch $H_3$, nevertheless after a first passage through this retarder, it is again fed back to the input of the retarder through the switch $H_4$, because at this time, this switch is brought into the operative position (not shown) by a pulse of the control signal $a_3$. At the same time, an element $e_6$ of the input signal $x$ is conveyed, without delay to the output through the switch $H_3$ which is likewise actuated (indicated in broken lines in FIG. 14). Only three element lengths later does the stored element $e_3$ finally appear through the switch $H_4$ restored to the normal position, in the output signal $y$. In a similar manner, the elements $e_1$, $e_4$ and $e_7$, $e_{10}$ for example are also transposed, while $e_5$ and $e_8$ are passed on with simple delay without being transposed. This process is illustrated again, with the associated control signals, in FIG. 15. The advancing of the time zero (i.e., the shifting left of the time frame) should again be noted in this simplified illustration. As a result of operation with control pulses having the uniform length $T_o$, the effect is achieved that a plurality of elements of corresponding length always travel through the retarder.

In order to avoid a further feedback of all elements which have already been delayed twice, care must be taken to ensure that no further pulse follows a pulse of the control signal $a_3$ with the spacing $3T_o$. For this reason there is provided in the cipher-signal addition circuit $SZ_3$, a blocking switch $U_3$ which is actuated by the pulses of the control signal $a_3$ delayed by three element lengths $T_o$ in $V_3$, so that any following inadmissible control pulses are eliminated. Here, too, the cipher signals $w_3$, from which the control signals $a_3$ are obtained by suppression of inadmissible pulses, are taken from a cipher-signal generator SG.

In order to further increase the effectiveness of a time coding, the interconnection of a plurality of pair-exchange process circuits is advisable so that an increase in the possible displacements of each element comes about. In FIG. 16, a device ZT can be seen in which a first transposition in pairs is effected of elements of the clear signal $x$ through the retarder $R_3$ and the switches H3, H4, as a result of which a signal $y$ results, the elements of which may have additional displacements by $3T_o$ or $6T_o$ as in FIGS. 13 and 15. A second transposition in pairs is then effected through the retarder $R_1$ and the switches $H_1$ and $H_2$ with smaller displacements similar to FIGS. 6 and 8. The cipher-signal addition circuit SZ is also equipped with retarders $V_3$ and $V_1$ respectively, corresponding to FIGS. 13 and 11 respectively, in accordance with the unequal displacement times. This cascade connection of two transposition processes in pairs produces, from a clear signal $x$, the element numbers of which are designated by $n(x)$ in FIG. 18, first the intermediate signal $y$, of which the element numbers $n(y)$ are likewise given in FIG. 18, and finally, as a result of further element exchange in pairs, the output signal $z$ with the element numbers $n(z)$. Whereas displacements of 0 and +3 element lengths occur in the intermediate signal, the second exchange produces displacements of $0$, $+T_o$, $+2T_o$, $+3T_o$, $+4T_o$ can appear in the output signal $z$ in comparison with a mid position of the elements. In view of the fact that even this mid position has a displacement of $4T_o$, because negative displacements in time are impossible, the output elements of the time coding device ZT therefore appear with delays of O, $T_o$, $2T_o$ $3T_o$, . . . to $8T_o$ in comparison with the input elements. The delays occurring in the example shown are given in FIG. 19 as integral multiples $r(n)$ of the element length $T_o$ over the element numbers n of the input signal $x$. It can be seen that a very effective mixing of all the elements of the message comes about already as a result of pair exchanging twice. This process could be extended by one or more further pair exchanges. In this case, it is advisable to avoid the same storage times for the various exchange processes. The number of possible displacements becomes particularly high if the storage times are graduated in accordance with a ternary system, in that retarders are used having transit times of $T_o$, $3T_o$, $9T_o$ . . . $=3^iT_o$ ($i$ = a whole number), because thus all total delays $mT_o$ between 0 and $(3^{k+1}-1)T_o$ are possible ($m$ = a whole number, $k$ = total number of the pair transposition devices).

A device which as shown in FIG. 17, corresponds largely to the transposition device at the transmitting end, serves for the re-exchange of the message elements at the receiving end. From the coded signal $z^*$ received, which coincides with $z$, as a result of a first re-exchange with the retarder $R^*_1$ and the switches $H^*_1$, $H^*_2$, an intermediate signal $y^*$ is again formed which coincides with $y$ and (apart from the delay of the transmission channel) is delayed by $2T_o$ in comparison with $y$, because the untransposed elements are subjected to a delay of $T_o$ at the transmitting end and at the receiving end. With the transposition of the elements $e_5$ and $e_6$ shown in FIG. 7, re-exchange of these elements comes about when a following analogue transposition device receives a control pulse $a$ at the moment the element $e_5$ is received, so that this element is not further delayed, while the preceding element $e_6$ is delayed by $2T_o$ and so comes back into the original position in relation to $e_5$. Accordingly, the control pulses $a^*_1$ of the first re-exchange with the switches $H^*_1$, $H^*_2$ must be displaced by $T_o$ in comparison with the control pulses $a_1$ of the exchange shown in FIG. 16 with the switches $H_1$, $H_2$, in the device also shown in FIG. 17. This displacement is achieved by an additional delay $T_o$ of the cipher signal $w^*_1$ at the receiving end (FIG. 17). In this case, it is assumed that the cipher-signal generator SG* at the receiving end is synchronized with the cipher-signal generator SG at the transmitting end by auxiliary signals $u$ and $u^*$ transmitted separately, for example by the method described in the Swiss Pat. No. 361,839. In the case of element exchange in pairs with displacement by three element lengths as shown in FIGS. 13 and 14, it should be noted that an element $e_3$ which is displaced by six element lengths in the exchange process at the transmitting end (see FIG. 14), must not be further delayed during the re-exchange at the receiving end, while the element $e_6$ which is not delayed at the transmitting end has to be delayed by six element lengths at the receiving end. The control pulse for the re-exchange at the receiving end must therefore coincide with the element $e_3$ received; that is to say the control of the re-exchange must be delayed by $3T_o$ in comparison with the control at the transmitting end, if no additional delays have to be taken into consideration. In the transmission system as shown in FIGS. 16, 17, however, as already explained, there is a difference in time of $2T_o$ between the signals $y$ and $y^*$, so that the control signal $a^*_3$ for the re-exchange in pairs in the retarder $R^*_3$, the transit time of which amounts to $3T_o$, must be delayed altogether by $3T_o + 2T_o = 5T_o$ in comparison with the control signal $R_3$ for the exchange in pairs in $R^*_3$. The retarder $W^*_3$ is provided in the cipher-signal addition circuit SZ* at the receiving end to ensure this delay time (FIG. 17).

Figure 21:
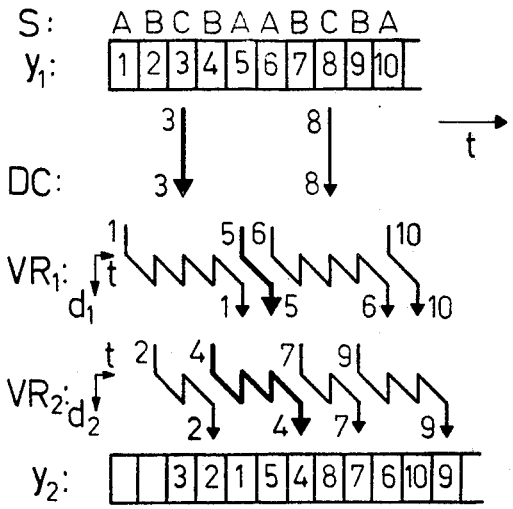
FIGS. 21 and 22 are diagrammatic illustrations of permutations in accordance with a constant program.

The effectiveness of an enciphering by exchanging elements in pairs is also increased by additional permutation of the elements in accordance with a fixed program. A device $ZT_o$, which is suitable for this, may contain two retarders $R_1$, $R_2$ with an identical transit time, as shown in FIG. 20. Individual elements of the input signal $y_1$ can be supplied to these retarders through the switches $A_1$ and $B_1$ respectively, while the extraction of elements to form the output signal $y_2$ is possible through the switches $A_2$ and $B_2$ respectively. When the switches are not actuated, however, the retarder output is connected back to its input in each case. Finally direct passing-on of elements of the input signal $y_1$ to the output of the device is possible through the further switches $C_1$, $C_2$. The switches $A_1$, $A_2$ are always actuated simultaneously, likewise the switches $B_1$, $B_2$ and $C_1$, $C_2$, for example in accordance with the periodic program S given at the top in FIG. 21 (the switches not recited in a time interval being in the normal position in each case). The elements of the input signal $y_1$ are numbered consecutively with the numbers given below the switch program S in FIG. 21. The switching through by the switch C is indicated diagrammatically underneath (DC). The element No. 3 is passed on directly through the switch C to the output so that this element appears without delay in the output signal $y_2$ (FIG. 21 bottom). The element No. 5 on the other hand, passes through the simultaneously actuated switch $A_1$ to the retarder $R_1$ (the delay in $R_1$ is illustrated symbolically in the next line "$VR_1$"), and immediately after being delayed only once, it is conveyed to the output through $A_2$. The input element No. 4, which reaches the retarder $R_2$ through the switch $B_1$ (see next line "$VR_2$"), on the other hand, is fed back from the output of the retarder to the input thereof through the switches $B_1$, $B_2$ which alternate in the normal position after this input; it is only extracted therefrom again after passing through three times and added to the output signal $y_2$, as soon as the switches B are actuated again. On the assumption that the transit time of a retarder R coincides with the element length $T_o$, such storage and switching-over finally leads to an output signal $y_2$ with elements transposed in time, as can be seen from the resulting numbering shown at the bottom of FIG. 21.

Figure 22:
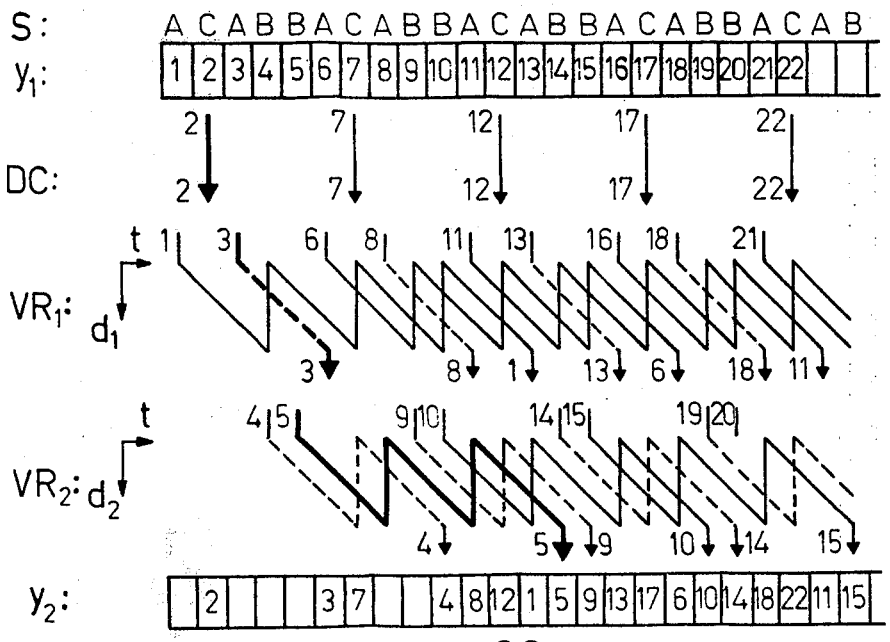

Mutual displacements of the elements by greater times are possible with an increased transit time of the registers R. With a delay time $3T_o$ of the registers $R_1$ and $R_2$, the displacements which can be seen from FIG. 22 result, as the switch control is effected in accordance with program S given across the top of FIG. 22. The element No. 2 for example is transmitted directly through switches $C_1$, $C_2$ while the element No. 3 is delayed by three element lengths in the retarder $R_1$. The element No. 5, on the other hand, after being fed back twice, is subjected to a delay of $9T_o$ in the retarder $R_2$. The element No. 4 is subjected to a delay of $6T_o$ in the same retarder and the element No. 1 is actually delayed by $12T_o$ in $R_1$. Because of the periodic repetition of the switching-over program, the elements No. 1, 6, 11 . . . are delayed by the same amounts, likewise the elements 2, 7, 12 . . . and the elements 3, 8, 13 . . . and so on. Further possibilities for carrying out the periodically repeated transposition are provided, for example, by increasing the delay times of $R_1$ and $R_2$ to $4T_o$ or even greater amounts, or by using three or more retarders which are connected to the inputs and outputs of the device in a similar manner by switches actuated in pairs.

Figure 23:
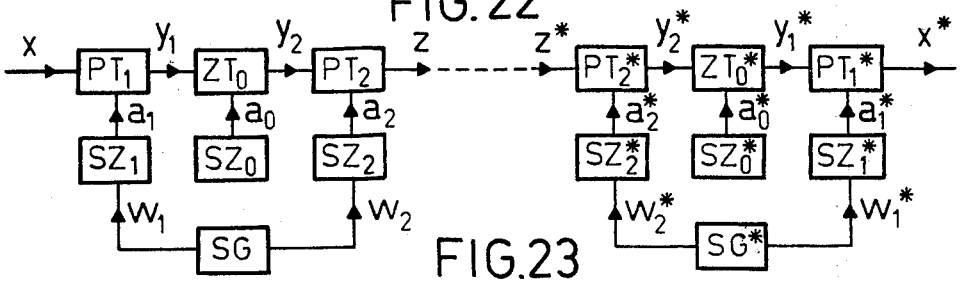
FIG. 23 shows a block circuit diagram of devices for the time coding by element exchanges in pairs in conjunction with permutations in accordance with a fixed program and for the decoding by element exchanges in pairs in conjunction with permutations.

An interconnection of the device $ZT_o$, which has been explained, for the periodically repeatd permutation of message elements, with devices $PT_1$ and $PT_2$ for the exchange of such elements in pairs, is shown in FIG. 23. The control-signal additions for obtaining the control signals $a_1$ and $a_2$ from the cipher signals $w_1$ and $w_2$ are designated by circuits $SZ_1$ and $SZ_2$. A further control-signal addition circuit $SZ_o$ serves to produce the periodically repeated control signals $a_o$ for the actuation of the switches A, B, C of the permutation device $ZT_o$. The corresponding devices at the receiving end for reversing the transpositions and the signals appearing in the course of this are shown in FIG. 23 using the same symbols. An additional asterisk (for example $y^*_2$) serves to make a distinction from the devices and signals at the transmitting end. The transit times of the retarders contained in $PT_1$ and $PT_2$ are preferably selected unequal in order to obtain, once again, as great a multiplicity as possible of the element displacements which can be achieved.

The interconnection described, between devices for exchanging elements in pairs and a device for permutating elements in accordance with a fixed program, leads to resulting transpositions of the message elements which are still very difficult to take in at a glance even with knowledge of the fixed permutations. In particular, the fact should be noted that the number of possible displacements of elements is considerably greater than with simple exchange of elements in pairs and that the total expenditure necessary remains comparatively low because even with the permutations, operation involves optimum utilization of all signal stores.

Supplementing the exchange of elements in pairs by an additional time coding of known type is, of course, also possible. In this case, too, the individual transposition operations at the receiving end must be provided in reverse sequence compared with the transmitting end. There is also the possibility, however, of an effective amplification of the exchange of elements in pairs according to the invention by enciphering processes of another kind, such as additional splitting up of the elements into individual frequency bands which are transmitted in a transposed frequency position. In particular, there is also the possibility of a division into two or more frequency bands, which are each subjected, independently of one another and in accordance with a different program, to a time coding by exchange of elements in pairs. Thus apart from at least two devices for the exchange of elements in pairs, separate filters for dividing the message into at least two sub-bands are necessary for carrying out such enciphering.

The effectiveness of the exchange of elements in pairs can also be increased by interconnecting two or more devices for the exchange of elements in pairs, working with different lengths of element. The element lengths are preferably in an integral ratio to one another so that at least some of the element dividing points are common to the longer and shorter elements.

Instead of a direct transmission of the coded signals from the device at the transmitting end to that at the receiving end, provision may also be made for recording the coded signals at the transmitting end, for example a sound-tape recording. This recording can then be played back again at a later time and be supplied to the deciphering device at the receiving end to recover the original clear signals.

Although this invention has been described with respect to its preferred embodiment, it should be understood that many variations and modifications will now be obvious to those skilled in the art and, therefore, it is preferred that the invention be limited not by the specific disclosure herin but only by the appended claims.

What is claimed is:

1. A method for the enciphered transmission of messages by splitting up the clear signals to be transmitted into elements of equal length $T_o$, which are transposed at the transmitting end by being delayed by at least partially unequal times and are re-transposed at the receiving end by being further delayed by at least partially unequal times, said method comprising the steps of transposing a pair of elements at a time, which elements have a specific mutual spacing, at the transmitting end, and re-exchange of the same elements in pairs at the receiving end, the pairs of elements which are transposed at the transmitting end and re-transposed at the receiving end being determined by providing irregular trains of control pulses which are identical at the transmitting and receiving ends, and delaying those elements which do not belong to the pairs of elements by a fixed time T at the transmitting and receiving ends, and delaying the element of each pair arriving first at the transmitting end and at the receiving end by double the time 2T and passing the second element of the pair without delay.

2. A method as claimed in claim 1, wherein the delay time T is selected to coincide with the element length $T_o$ (FIG. 11).

3. A method as claimed in claim 1, wherein the delay time T is selected to coincide with an integral multiple of the element length $T_o$ (FIG. 13).

4. A method as claimed in claim 1, characterized by repeated carrying out of the exchange of pairs of elements at the transmitting end and of the re-exchange at the receiving end, wherein the first step of performing the exchange of elements at the transmitting end is carried out in accordance with control pulses developed thereat and the step of performing the last exchange of elements at the receiving end is determined by transmitting said control pulses to the receiving end for controlling said last exchange.

5. A method as claimed in claim 4, wherein equal time delay lengths are employed at the transmitter and receiver ends in the repeated exchanges of elements in pairs so that the element of a pair which has not been delayed at the transmitter end is subjected to a delay at the receiver end which is equal to the delay length imposed upon a delayed element at the transmitter end.

6. A method as claimed in claim 4, wherein the exchanges of element pairs at the transmitter end comprises the employment of unequal time delay lengths during each such repetition to further increase the mixing of elements of the message.

7. A method as claimed in claim 4, wherein repetition of the exchanges at the transmitter end is performed with a varied delay time T (FIG. 16) employed during each repetition.

8. A method as claimed in claim 7 wherein a ratio of 1:3 for the delay times of the exchanges is employed.

9. A method as claimed in claim 1, further comprising the step of combining the exchanges of elements in pairs with an additional permutation of the elements in accordance with a predetermined program (FIG. 23).

10. A method as claimed in claim 1, further comprising the step of combining the exchange of elements in pairs with an additional known time coding with a varying program for the element transposition.

11. A method as claimed in claim 1, further comprising the step of recording the enciphered signals on an information carrier at the transmitting end and playing back the information carrier at a later time at the receiving end.

12. A method as claimed in claim 1, further comprising the step of developing the message elements by converting the message signals into pulse form.

13. A method as claimed in claim 12, wherein the message elements are formed from a pulse train which is quantized in two stages (FIGS. 2, 3).

14. A method as claimed in claim 12, wherein the message elements are formed from a pulse train which is quantized in multiple stages.

15. A method as claimed in claim 12, wherein the elements are formed from analogue pulses without fixed amplitude graduation by the step of sampling said analogue pulses and converting the sampled pulses to digital form prior to undergoing paired exchange.

16. A method as claimed in claim 1, wherein the elements are formed by the step of dividing a variable analogue signal into equal element lengths (FIG. 5).

17. A method as claimed in claim 1, wherein the elements are formed by the step of periodically scanning an analogue signal (FIGS. 4, 5).

18. A method as claimed in claim 1, wherein the elements are formed by the step of converting the message signals in elements whereby each element consists of an individual pulse (FIGS. 2, 4).

19. A method as claimed in claim 1 wherein the step of forming elements comprises forming elements each comprised of a plurality of individual pulses (FIGS. 3, 5).

20. A system for encoding messages through the transposition of selected message elements, comprising at least one element exchanger means provided at the transmitting and at the receiving end for exchanging pairs of elements and at least one control addition means (FIGS. 11, 13);

said element exchanger means having an input for receiving message elements and an output for delivering exchanged elements for transmission and containing signal retarder means having a constant delay tine T for delaying elements selectively applied thereto, and first and second electronic changeover switch means respectively positioned at the input and output of the retarder means;

said first changeover switch means having first and second operating positions for respectively connecting the input of the element exchanger means directly to the output of the element exchanger means and for connecting the input of the retarder means to the input of the exchanger means;

said second changeover switch means having first and second operating positions for respectively directly connecting the output and input of the retarder means and for connecting the output of the retarder means to the output of the element exchanger means;

said first and second electronic changeover switches being normally maintained in their first positions;

means for generating a quasi-statistical pulse train;

said control addition means containing an electronic interrupter means for selectively cancelling individual pulses of said statistical pulse train (cipher signal) said interrupter means having a control input for cancelling a pulse at its output upon receipt of a control inhibit pulse;

said interrupter means being actuated through pulse retarder means having a delay time T for delaying pulses at an output of said interrupter means and replacing the delayed pulses to the control input of said interrupter means so that no pulses which have a mutual spacing T appear at the output of the interrupter;

the output pulses of the interrupter being coupled to said first and second electronic changeover switch means of the element exchanger means to move the said first and second electronic changeover switch means to their second positions.

21. A device as claimed in claim 20, wherein said retarder means has a delay time T which coincides with the length of a message element.

22. A device as claimed in claim 20, wherein said signal retarder means has a delay time T which coincides with an integral multiple of the length of a message element.

23. A device as claimed in claim 20, wherein the pulses supplied to the pulse retarder means in the control addition means, comprises the input signal of the electronic interrupter means (cipher signal) (FIG. 9).

24. A device as claimed in claim 20, wherein the pulses supplied to the pulse retarder means in the control addition means comprises the output signal of the electronic interrupter means (FIG. 11).

25. A device as claimed in claim 20, further comprising a second element exchanger means similar to said first exchanger means, said first and second element exchanger means being connected in cascade fashion with the input of the second exchanger means being coupled to the output of the first exchanger means (FIG. 16).

26. A device as claimed in claim 25, wherein the signal retarder means of the two element exchanger means have different delay times.

27. A device as claimed in claim 26, characterized in that the delay time of one of said signal retarder means is one-third (⅓) the delay time of the other signal retarder means.

28. A device as claimed in claim 25, wherein said element exchanger means includes means adapted to exchange elements having unequal element lengths.

29. A device as claimed in claim 20, further comprising signal scanner means preceding said element exchanger means to convert variable input signals into discrete analogue pulses for application to the input of said exchanger means.

30. A device as claimed in claim 29, wherein the scanning frequency of said scanner means is selected to be an integral multiple of the element repetition frequency.

31. A device as claimed in claim 20, wherein the homologous element exchanger means with the associated control addition means are connected in cascade in a first sequence at the transmitting end and in a second reverse sequence at the receiving end which second sequence is the reverse of that employed at the transmitting end (FIG. 17).

32. A device as claimed in claim 20, further comprising analogue-digital converter means for converting the analogue input into digital signals for application to the input of said exchanger means, said signal retarder comprising digital retarder means for delaying binary pulse trains derived from said converter means.

33. A device as claimed in claim 20, further comprising digital-analogue converter means at the output side of the receiver end exchanger means to obtain analogue output signals fom the digital elements transposed to return to their original order.

34. A device as claimed in claim 20, further comprising Delta modulation converter means at the input side of said exchanger means for generating a pulse train from the input signals by a Delta modulation method.

35. A device as claimed in claim 20, further comprising electric filter means for dividing the whole frequency band of the message into at least two component frequency bands with separate time coding of the individual component frequency bands by element exchange in pairs in said exchanger means in accordance with different transposition programs and separate decoding thereof.

36. Means for the permutation of message elements in accordance with a predetermined program comprising:

an element exchanger having an input for receiving the message elements to be permutated and an output for delivering permutated elements;

first and second retarder means each having a delay time $T_1$ for delaying elements applied thereto;

first and second sets of changeover switches respectively associated with said first and second retarder means and having a first normal position for connecting the inputs of said first and second retarder means to said exchanger means input and for connecting the outputs of said first and second retarder means to said exchanger means output, and a second operative position for connecting the output of each retarder means to its input;

an auxiliary message element path;

a third set of switch means having a first normal position for connecting said auxiliary path between said exchanger means input and output and having a second operative position for connecting the output of the auxiliary path to its input;

means for operating said first, second and third sets of switch means so that only one of said sets of switch means is in the operative position during the interval of any message element.

37. A device as claimed in claim 36, wherein the delay time $T_1$ of the retarder means is adapted to coincide with an integral multiple of the element length.

38. A device for encoding or decoding messages by transposing selected pairs of message elements comprising:

delay means having an input and an output;

a direct signal path for passing signals between its input and the output of the device with no delay;

a feedback signal path for passing signals between the output and the input of said delay means;

first switch means for receiving said message in serial fashion and for selectively coupling said message either to said delay means input when in a first condition or to said direct signal path input when in a second condition to cause the message to appear at said device output with no delay;

second switch means for selectively coupling the delay means output to said device output when in a first position or to said feedback signal path when in a second condition;

control means for operating both said first and second switch means;

said control means comprises means for generating a random pulse pattern;

means for sampling successive pulses in said random pulse pattern to inhibit selected ones of the pulses, so that a pulse interval is always followed by a no pulse interval, and applying the resulting pulses as control signals to said first and second switch means.

39. The device of claim 38 wherein said generating means comprises means for generating quasi-statistic signal pulses said sampling means comprising logical gating means having a first input coupled to said pulse generating means and a second input and an output, delay means coupled between said gating means second input and output, said gating means inhibiting the generation of a control means output pulse for operating said switch means to their second conditions whenever pulses are simultaneously present at said gating means first and second inputs.

40. A device for altering a message by transposing selected ones of the message elements said device comprising;

an input for receiving the message to a utilization device after undergoing element transposition;

first and second and third signal paths;

at least two of said signal paths having means for imparting a delay to message elements applied thereto, while the remaining signal path imposes no delay to message elements applied thereto;

first, second and third feedback paths;

first, second and third switch means respectively associated with one of said signal and feedback paths whereby each switch means, either couples a feedback path across its signal path when in a first switch condition or couples the signal path between said input and said output when in a second switch condition;

control means for operating said first, second and third switch means so that no more than one of said switch means is in said first condition at any given time.

41. A device as claimed in claim 36, wherein the delay time $T_1$ of the retarder means is adapted to coincide with the element length.

* * * * *